US009737756B2

(12) United States Patent
Gillis

(10) Patent No.: US 9,737,756 B2
(45) **Date of Patent: *Aug. 22, 2017**

(54) DORSIFLEXION APPARATUS

(71) Applicant: Charles Gillis, Whitman, MA (US)

(72) Inventor: Charles Gillis, Whitman, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/757,189

(22) Filed: Dec. 2, 2015

(65) Prior Publication Data

US 2016/0206920 A1 Jul. 21, 2016

Related U.S. Application Data

(63) Continuation-in-part of application No. 13/998,427, filed on Oct. 31, 2013, now Pat. No. 9,242,141.

(51) Int. Cl.

| | |
|---|---|
| ***A63B 21/00*** | (2006.01) |
| ***A63B 23/08*** | (2006.01) |
| ***A63B 21/055*** | (2006.01) |
| ***A63B 21/04*** | (2006.01) |
| ***A63B 21/02*** | (2006.01) |

(52) U.S. Cl.

CPC ..... *A63B 23/08* (2013.01); *A63B 21/00061* (2013.01); *A63B 21/00069* (2013.01); *A63B 21/023* (2013.01); *A63B 21/028* (2013.01); *A63B 21/0414* (2013.01); *A63B 21/0552* (2013.01); *A63B 21/0555* (2013.01); *A63B 21/0557* (2013.01); *A63B 2208/12* (2013.01)

(58) Field of Classification Search

CPC ..... A63B 22/18; A63B 22/16; A63B 21/02; A63B 21/023; A63B 21/028; A63B 21/04; A63B 21/055; A63B 21/0552

See application file for complete search history.

(56) References Cited

U.S. PATENT DOCUMENTS

| | | | | |
|---|---|---|---|---|
| 5,205,803 A * | 4/1993 | Zemitis | ..... | A63B 21/0552 482/121 |
| 7,794,367 B2 * | 9/2010 | Hall | ..... | A63B 21/0552 482/129 |

OTHER PUBLICATIONS http://www.merriam-webster.com/dictionary/loop, last visited Sep. 19, 2016.*

* cited by examiner

*Primary Examiner* — Sundhara Ganesan
*Assistant Examiner* — Rae Fischer
(74) *Attorney, Agent, or Firm* — John P. McGonagle

(57) ABSTRACT

An apparatus comprising a base, support and resistive band to provide consumers a method for conditioning, preventing or rehabilitating injuries from running, sports and fitness activities.

10 Claims, 6 Drawing Sheets

DORSIFLEXION APPARATUS

CROSS-REFERENCE TO RELATED APPLICATIONS

This application is a continuation-in-part of U.S. application Ser. No. 13/998,427, filed Oct. 31, 2013, and now U.S. Pat. No. 9,242,141, issued Jan. 26, 2016.

FIELD OF THE INVENTION

This invention relates to fitness and rehabilitation devices that are used for the lower leg injuries, more specifically an apparatus to strengthen and or rehabilitate injuries by resistive movement of the lower leg.

BACKGROUND OF THE INVENTION

For decades consumers have enjoyed outdoor health, fitness and sports activities. In more recent years the health and fitness market has grown significantly as consumers become more aware of health risks that may be linked to, high blood pressure, obesity and diabetes that may be a result of inactive lifestyles and rising costs in the healthcare insurance. The trend has become more apparent from young adolescents to adults. In some instances programs have been changing the way consumer eat and participate in outdoor health and fitness activities. A consumer's trend has been recognized with more exercise, walking, running and participation in sports and other outdoor activities.

The most common outdoor activity is running or walking exercise, and although this is not new for many the trend seems to be growing along with the health and fitness industry. The injuries that occur in this trend exhibit the need for more equipment and rehabilitation devices. So many people are living more active lifestyles and as a result many new products are introduced into the market. As the market grows, health professionals are experiencing injuries and other complaints from patients that are sometimes remedied with pain killers, medications and cold and hot therapy. The specific cause for these injuries remains unknown in many cases, but the prescriptions are quite common. Most prescriptions involve pain medications which can be addictive and sometimes offer a patient temporary relief on the injury or condition. Several common injuries have been known in the lower leg extremity. Over the years the consumer have lived with a condition from sports and fitness that could be prevented and often avoided with the proper conditioning. There are products on the market that offer inserts to shoes, special shoes and other elastic bands or supports to wrap around a foot or shoe. These devices do not satisfy the need for most consumers and do not take into consideration the ease of use, the real motion required to strengthen the lower leg, and or provide preventative maintenance for a variety of injuries. Shin splints are one injury that is common to athletes and limited products are found on the market that provides therapy or rehabilitation in the running, sports and fitness marketplace.

Some devices may exist on the market today, but few devices offer an apparatus as the proposed invention to provide a method to help prevent injuries or remedy an injury in the lower leg extremity. The need for a device ergonomically designed to strengthen the lower leg extremity from adolescent to adults that is simple to use, with varying levels of resistance, minimal parts and portable is desired in today's market.

SUMMARY OF THE INVENTION

In general, in one aspect, the invention provides an apparatus that strengthens and conditions a lower leg extremity, utilizing a dorsiflexion motion with resistive movement at an angular displacement of the foot and ankle that can be used for both pre-conditioning and or rehabilitation. The foot is flexible consisting of bones, joints, muscles, and soft tissues that let us stand, walk, run, and jump. The apparatus consists of a base sized to fit a child to an adult foot, a support to engage the top surface of the foot and resistive band to provide selective resistive movement in a dorsiflexion motion. The dorsiflexion motion is defined as a motion of the lower leg extremity or foot from a heel to toe moving the foot at the toe end towards the body, or a foot pivoting around an ankle where the toes and arch of a foot is moving towards the lower shin on a human body. In this example, the foot and toes move toward the shin or knee, causing the muscles and angular rotation of the foot through or about a pivot point of the ankle.

Another aspect of the invention is to provide a base that can accommodate a foot size of a child, and also accommodate a foot size of an adult women and adult man. The sizes were researched with publications and experts in the shoe industry. The anatomical foot is divided into three planes, a transverse (top and bottom), frontal (divides front and back), and sagittal (divides left from right). The apparatus is sized appropriately considering the anatomical foot geometry of a child to an adult. Publications including Journal of Foot and Ankle Research, Anatomical Charts and Shoe manufacturers provided information including differences between barefoot and shoe sizes. The size is appropriately measured to offer a product that provides a universal fit and that will adapt to a anatomical foot size of a child up to an adult male at the upper end of the shoe size scale. The size is important to consider as the resistive movement and angular displacement of the device may affect the path and function of the device itself. The device accommodates the length and anatomical shape of the foot and is designed to fit the size of the consumer's foot from a child to an adult. The angular displacement of a foot and or shoe 8 inches in length may differ from that of a foot 13 inches in length.

Another aspect of the invention is to provide a resistive movement that may be adjustable for consumers with different conditioning levels of strength vs. resistance. In one particular case a young adult may require less resistance or in rehabilitation with a patient may require a change in resistance movement throughout a period of time. The invention apparatus provides a method to select, change and or increase resistance using the dorsiflexion motion with consumers, caregivers and medical professionals.

Another aspect of the invention is to provide a feature to simplify the use of the device, where the apparatus is designed to insert a foot or shoe inside without pre-loading the resistive movement member. The feature may include a recess pocket in the body of the base, or trough to position the foot or toe under the support and allow repetitive movement or displacement of the support. Another configuration may include the option or feature of incorporating an angle of the support bar that is configured within the base to allow the foot or shoe to be positioned inside the apparatus without lifting or preloading the pivoting member. The foot can be inserted and the apparatus utilized with no further action or secondary motion.

Another aspect of the proposed invention is a base comprising resistive or non-skid pads to prevent movement when the apparatus is in use or when placed on a floor. The slip resistant component may be one assembled to the base, or over molded, co-injection molded or the base itself made of a slip resistance material. Another feature may include a pad positioned on the apparatus that provides comfort between the foot and the apparatus. The pad can be part of the apparatus or assembled and or an optional removable component.

The apparatus may include one of the following, a single piece resistive band that is configured to resist movement in the dorsiflexion motion, made of several strands of elastic like material, a single strand of elastomer material and or a spring like material contained inside a sleeve or like member. The resistive band is guided by features on the apparatus such as a ample radius within the slots or a guide to allow the outer sleeve of the resistive band to extend within the guides of the apparatus and or base, allowing the resistive band to move, and stretch for linearly uniform displacement of the support member. The resistive bands are configured for both tension resistive force and or displacement which are defined by the number of strands, material and elongation properties of the elastic like material. Resistive bands can be selectively chosen by the consumer for increased tension, and coordinated by markings or color within the apparatus design. The base can also be configured to store the bands.

The apparatus support is configured to pivot about a portion of the base, and conform to the anatomical shape of a foot. The anatomical size and shape of the foot's metatarsals through the phalanges are configured to fit the to a support arm arc engaging end of the apparatus. The support extends like an arm from a pivot point to a foot engaging end which forms an arc in a "U" configuration is designed to accept the width of a child to the width of an average adult. The support configured with two bosses or extensions on opposite sides configured to attach a resistive band around the outer diameter of the boss or extension, and guided under the base for resistive tension. The support may also include one of the following features, foam like pad configured where the foot contacts the support for added comfort, an over molded portion where the foot contacts the support and an optional feature for a removable pad that can wrap around the support for hygienic purposes. The apparatus may also include a counter to read the number of cycles in use. The support can be configured with a stop to prevent stress, break or fracture of the support arm.

The features and benefits of a minimal number of components along with the configuration of a base support and selectively resistive band can offer consumers a device that is both useful and needed in today's market.

DETAILED DESCRIPTION OF PREFERRED EMBODIMENTS

Embodiments of the invention provide techniques for conditioning and or exercising the lower leg extremity, with a dorsiflexion motion apparatus. The apparatus utilizes an engineered resistive tension band with angular displacement movement for health, fitness and or rehabilitation. The dorsiflexion apparatus provides a device for runners, sports enthusiasts and athletes by conditioning the lower leg extremity and rehabilitating injuries including shin splints as a preferred method over drugs and other non-conventional remedies available on the market today. The apparatus is made of a minimum amount of primary components, these components are assembled with minimum effort and the apparatus is lightweight, portable for home, office and or travel.

Figure 1:
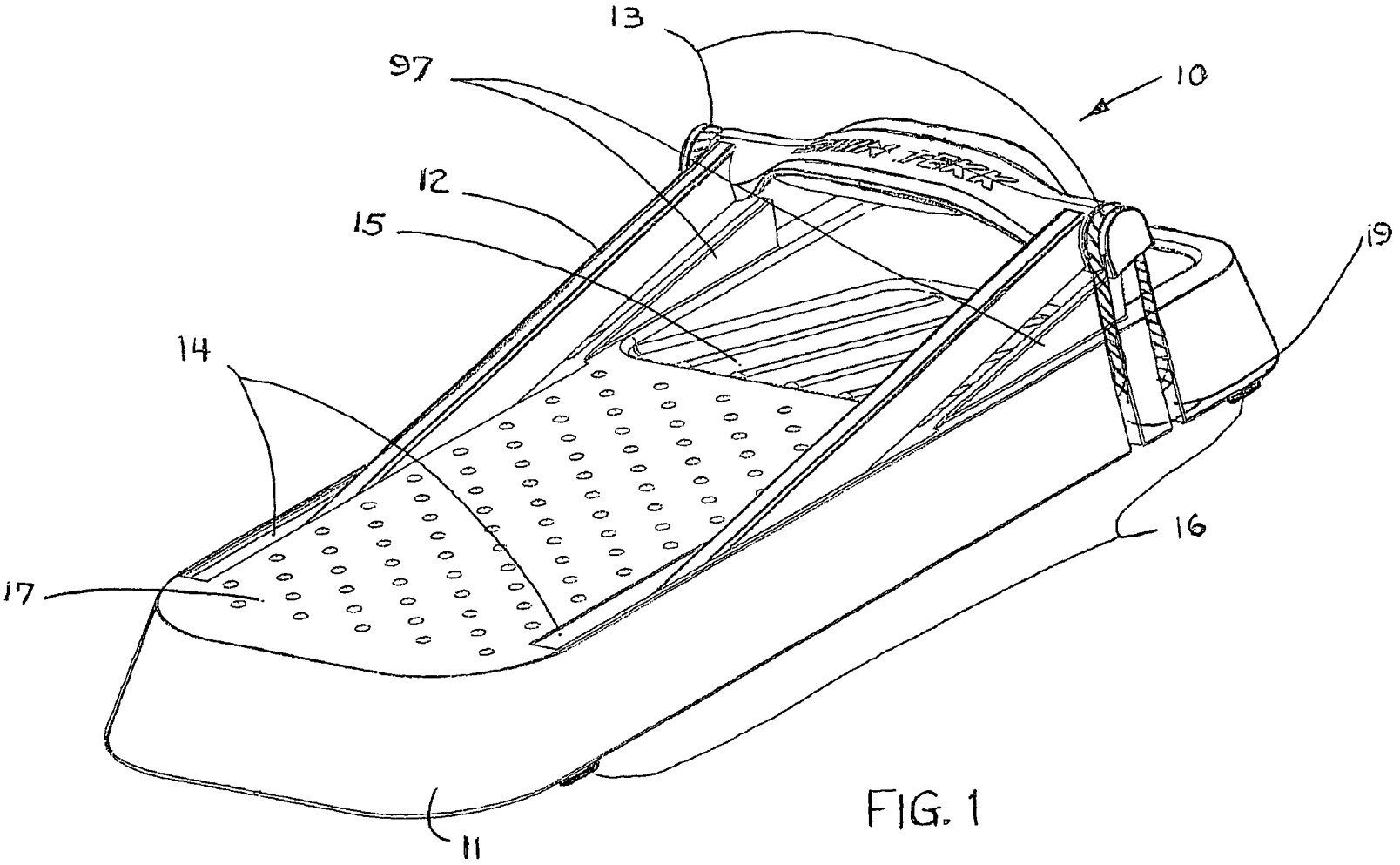
FIG. 1 is a perspective view of the apparatus.

In referring to FIG. 1, an apparatus 10 includes a base 11, support arm 12 and resistive band 13 as assembled. The base 11, configured to a size of a length and width to accommodate a range of a foot sizes from a child to an adult. The sizes accommodate a width, length and height as indicated by anatomical charts. An adult male foot the largest, an adult women foot the mid-size and a child or teen the smallest. The base 11, is approximately seven inches wide to eighteen inches in overall length in one configuration, assembled with a pivoting support arm 12, received by the base approximately eleven inches long in overall length. The anatomical foot is divided into three planes, a transverse, frontal, and sagittal. The apparatus is sized to accommodate a foot size of a child to an adult. Variations in measurements may be considered reasonable within plus or minus one inch tolerances. The smallest size would be most desirable for transport and travel, and the largest size may accommodate more options such as a counter and or commercial grade apparatus products. The base 11, further comprising a pair of parallel receiving slots 14 to receive a support arm 12, at a pivot point designated within the body of the base 11. The base 11 configured to a minimum overall height, preferably less than two inches and greater than one half an inch allowing the support arm 12 to engage and pivot inside the base 11. The base 11, comprising a trough or recessed area 15, preferably in the front end of the base to receive a front portion of a foot or shoe, without raising the support arm 12 or preloading the resistive band 13. The base 11 configured with a slip resistant pad or component 16, located on the bottom surface of the base 11 to prevent movement of the apparatus. The base 11, comprising an optional texture 17 on the top surface for added comfort or additional slip resistance while in contact of the sole of a foot or shoe. The base 11, configured with an optional ramp 17, to raise the support arm 12 to a desired angle for ease of inserting a foot. The angle can be selectable or fixed at a preferred 10 degree or greater angle. The angular motion of the apparatus support arm is desirable to move in an angular displacement of 20 or more degrees. The ramp 17 can also be configured to prevent damage to the arm or base when a force is applied to the top surface of the apparatus assembly. The ramp 17 can be configured on the two opposite sides of the base 11 top surfaces in the proximity of the end of the support arm 12, wherein the ramp is configured to contact and provide a solid base for the support arm 12. The support arm 12 is held approximately ten degrees or more from the base allowing a foot to be positioned into the apparatus without loading the resistive band 13. The resistive band 13 is guided within a radiused slot 19 and configured to move along the external surface of the base 11 and extend when tension is placed on the band 13 from the support arm 12 pivoted in a dorsiflexion motion (dorsiflexion lower leg-moving the foot about the ankle pivoting the toes and foot back towards the shin) with the apparatus. The resistive band 13 is made of multiple strands of an elastomer material 99 or like resilient material, covered with a shell or sleeve of plastic or fabric like material 98.

The resistive band 13 is preferably round in diameter, configured to be wrapped about the ends 18 of the support arm 12 and guided through a radiused slot 19 on the base 11 forming a loop or one piece resistive resilient band. The resistive band 13 can be configured with different materials to provide different tensions, or different colors and or markings to identify different tensions, features or styles. The resistive band 13 in one configuration may comprise of fifteen strands of elastic at a specified outside diameter enabling fifteen to sixteen pounds of resistive displacement and at another configuration of twenty strands of elastic at a similar specified outside diameter increasing the resistive force to about twenty four pounds displacement. It may be desired to increase or reduce the number of strands, or increase or reduce the diameter of the resilient material to offer various levels of tension on the apparatus. The materials can be can be single elastic, multiple strand elastic, metal spring steel, helical extension coil spring with looped ends and other similar type resistive tension type materials. The materials are preferable covered with a sleeve of fabric or plastic like material configured to slide or move along a surface. The sleeve may be color coordinated to coincide with a specific tension or linear displacement of the resistive band 13.

Figure 2:
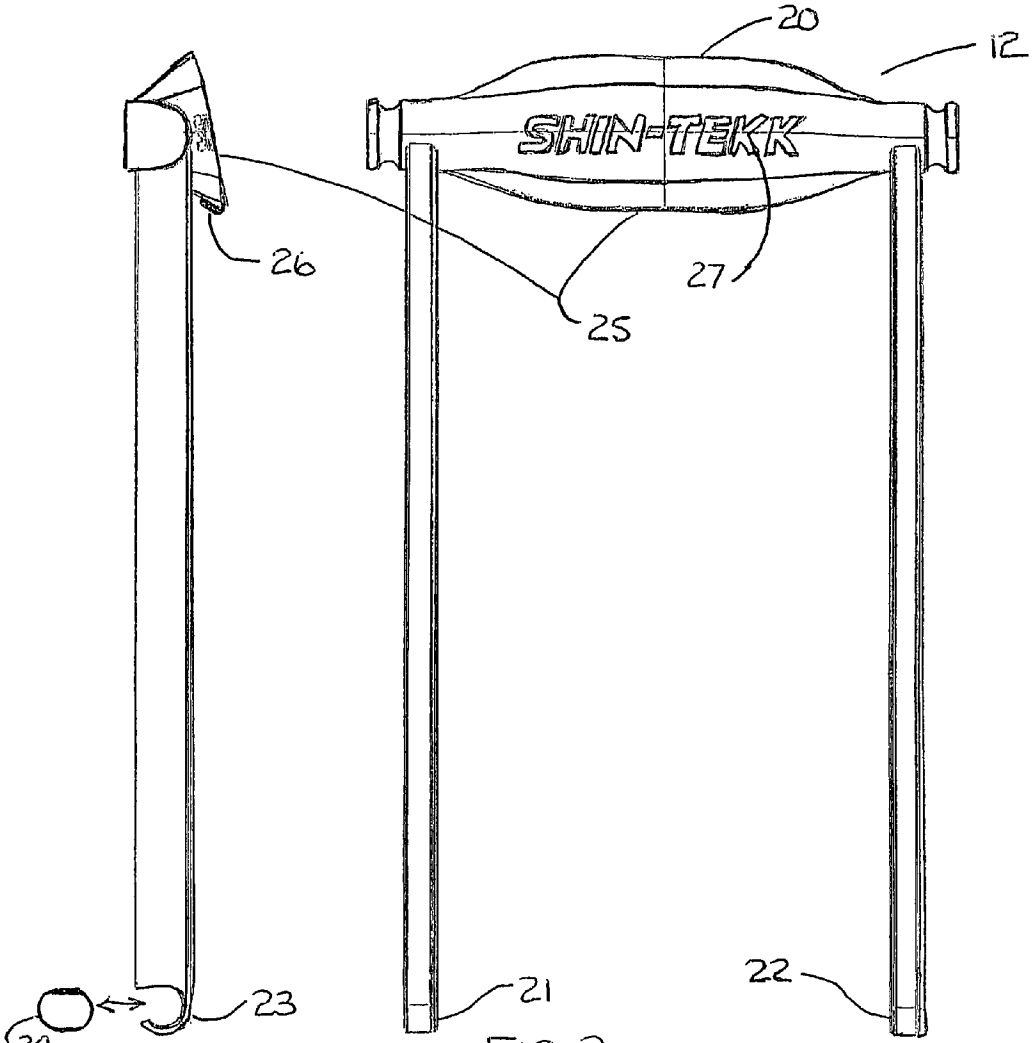
FIG. 2 is top and left side view of the support arm.

Referring to FIG. 2, a support arm 12 comprising a U shaped body, having a foot engaging end 20, and an opposite base engaging end 21, 22, wherein the opposite base engaging end 21, 22 are coupled to the base 11 as shown in FIG. 1. The support arm 12 comprising of a "C" shape or hook like end 23, and configured to be assemble and pivot within base 11 as shown in FIG. 1. When assembled the support arm 12 is rotated 90 degrees so the hook like end "C" shape or hook like end 23 can assemble onto the pin 24 on the flat sides on the diameter pin 24, the support arm can then rotate to lock into position and pivot about the pin 24. A support arm 12, further comprising a support arc 25 about the foot engaging end 20 within the U shaped body, sized to accommodate an arch of the topside foot surface of a child to an adult. The support arc 25, defined as a differentiable curve in two planes having a minimum width and depth to accommodate the top arch of a foot. The support arm 12 may also be configured to have a pad 26 to provide comfort to the engaging foot wherein the pad 26 is mounted to the bottom side of the support arm 12 foot engaging end 20. A support arm 12, may have an optional printing or logo 27 on the top surface and or be combined with a pad, co-injection or over molded elastomeric material (such as TPE thermo plastic elastomer, or TPR thermo plastic rubber) bonded to or with a secondary material or component such at the support arm 12. Printing, secondary components and or over molding are optional choices for features, branding and or styling the apparatus.

Figure 3:
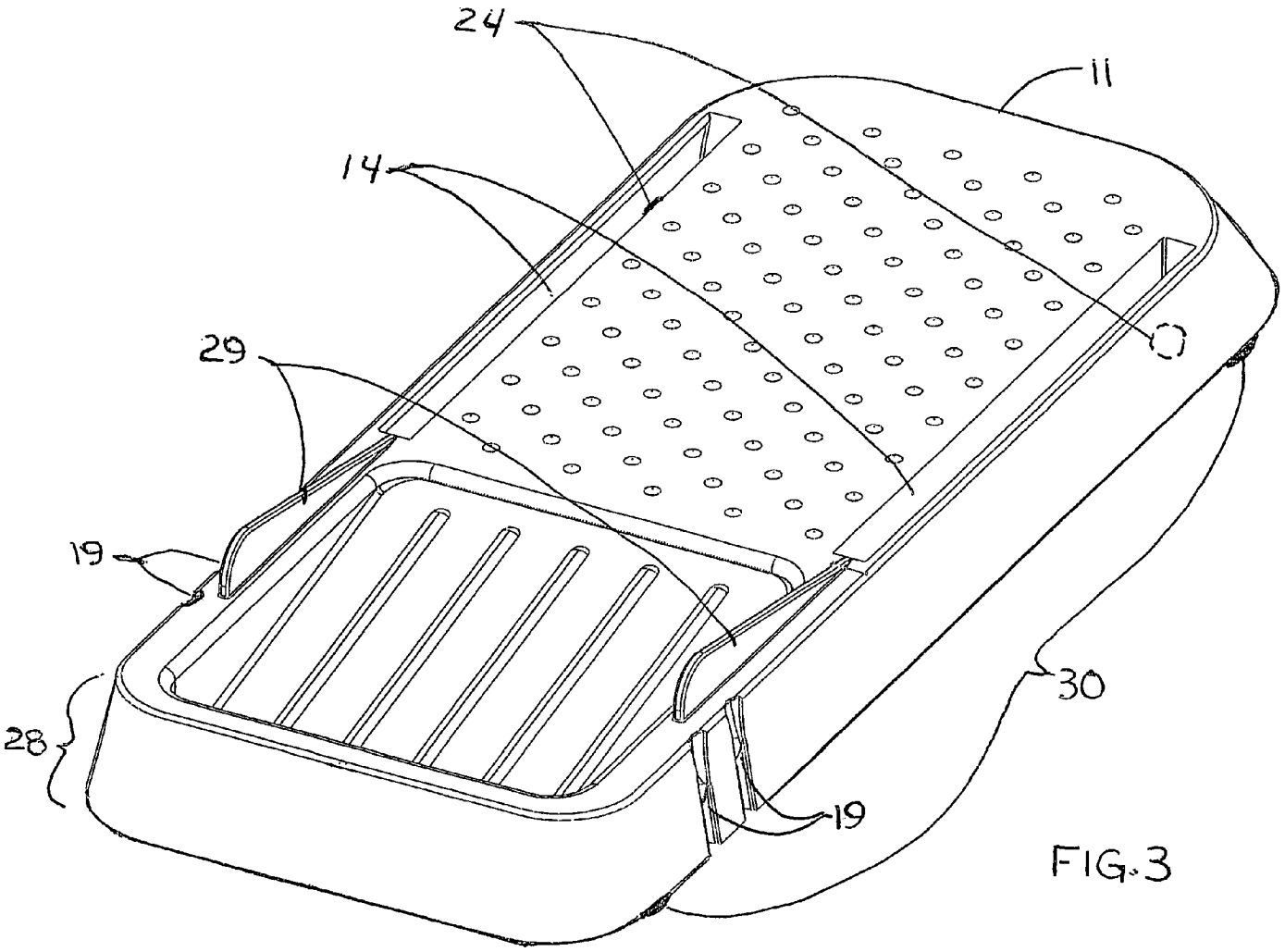
FIG. 3 is a perspective view of the base.

Referring to FIG. 3, a base 11, comprising a length and width to receive a foot size from a child to an adult, and further configured with a pair of parallel receiving slots 14, configured to receive a support arm 12 as shown in FIG. 2. The parallel receiving slots 14, configured with a pin 24 configured to engage a support arm 12 "C" hook like end 23 at a desired angle, and when rotated the support arm 12 locks securely onto the base 11. Base 11 is further comprises radiused slots 19, designed to receive a resistive band 13 through one side of the base 11 and guided through the bottom up through the opposite side of base 11. The radiused slot 19 preferably formed in a parallel pair, to each other starting from the top surface of base 11, through a portion of the overall height 28, of base 11. A ramp 29, extending from the base 11 at the end of the parallel receiving slots 14, configured to provide added support of the support arm 12, with in the assembled apparatus from an excessive load and or to maintain an optional preferred angle of 10 degrees or more. The ramp 29 provides a surface area for the support arm 12 to engage and allows the support arm 12 to be held at a desired angle to insert a foot or shoe into the apparatus without pre-loading the resistive bands 13 as shown in FIG. 1. The ramp 29, can be extended through the base 11, channel or slot 19 further extending support to a second component a support arm 12 that is coupled to the apparatus and prevent breakage. A slip resistant component 30, fixed to the bottom side of base 11 to help prevent movement while the apparatus is in use. The slip resistant component 30, made of rubber like material (i.e. Rubber, EDPM, SBR, other like non slip materials, non-marking, grommets, tape with adhesive backing and or over molded plastic).

Figure 4:
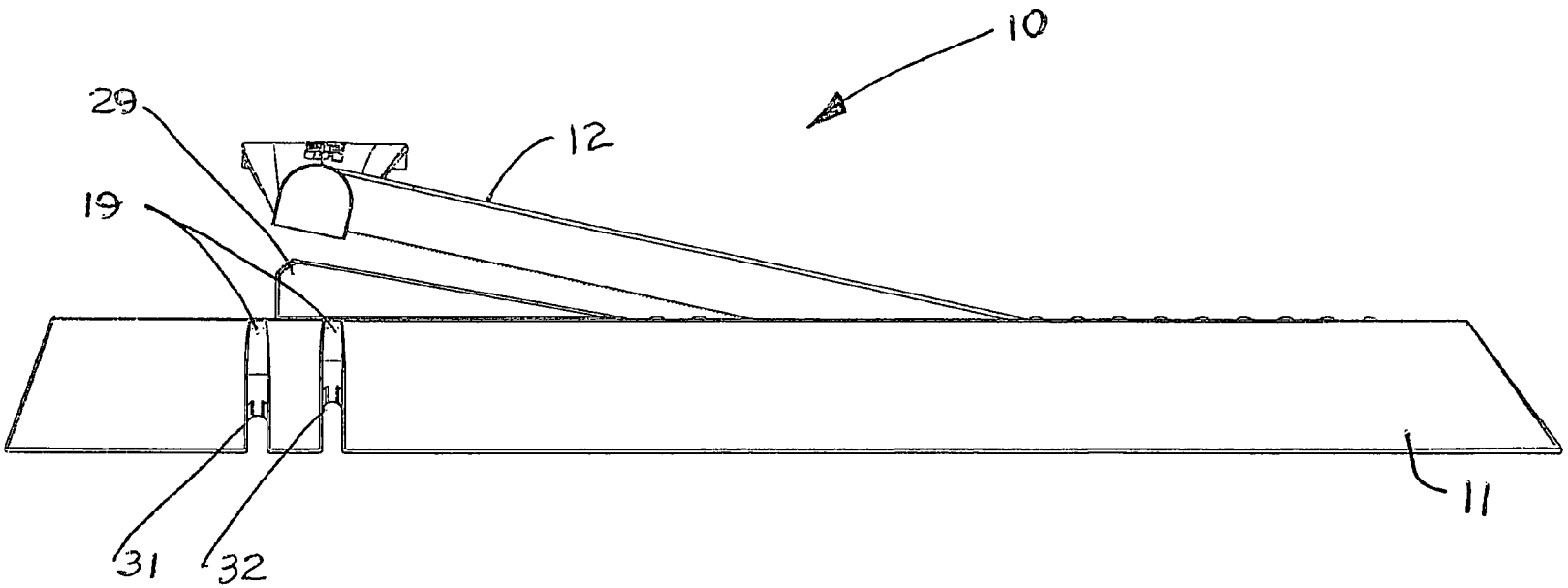
FIG. 4 is a left side view of the base and support arm assembly.

Referring to FIG. 4, an apparatus 10, including a base 11, a support arm 12 configured to receive a foot size from a child to an adult. The apparatus 10, having a base 11, with a recessed slotted area 19, configured to a position 31 and 32, about the front end of the base 11, wherein the recessed slotted area is stepped and cut away at two different positions and or relative heights 31, 32 to accommodate a resistive band and allow equal resistive force transferred to the support arm 12 when the apparatus is in use. The recessed slotted areas 31, 32, are configured onto both sides of the base 11 parallel and symmetrical in shape. The recessed slotted heights 31, 32 are also configured with full radii edges to allow the resistive band to move within the recessed slots when the apparatus is in use and the resistive band 13 as shown in FIG. 1 is loaded. A ramp 29, extending from the base 11 top surface area, about the mid-section of the base 11, towards the front end of the base 11. The ramp 29, configured to raise the support arm 12, to a desired angle of about ten degrees or more, allowing a foot to be inserted without pre-loading the apparatus or moving the support arm 12 to insert a foot. The ramp 29 can extend parallel along a length of the support arm 12. The ramp 29 offers both stability and surface area for a load applied to the support arm 12 transferred to the base 11 and reduces the load on the pivoting end of the assembly.

Figure 5:
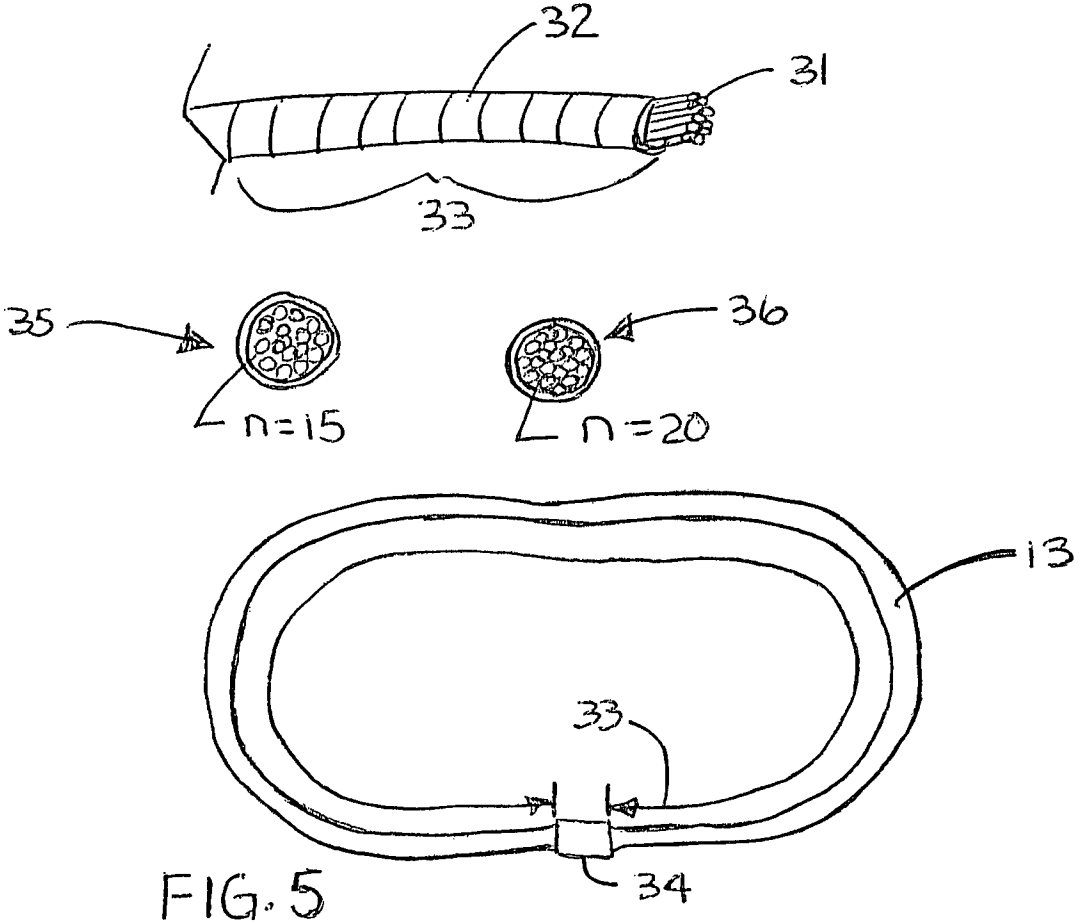
FIG. 5 is a detailed drawing of the resistive band and multi-strand configuration.

Referring to FIG. 5, in one configuration a resistive band 13, comprising an elastic material 31, a sleeve 32, and a desired length 33, coupled with a fastening device 34 to form a loop assembly. The resistive band 13 can be configured with a single strand of elastic material, and or multiple strands of elastic material. The resistive band 13, can be a single molded part design, and or an assembly of multiple components. The properties of the material such as the material itself including modulus of elasticity, diameter of the elastic strand, stiffness, and or number of strands can provide various desirable tensions that may be applied to the apparatus assembly. A resistive band 13, with elastic properties having a number of strands such as fifteen strands 35 may be desirable for lower resistance, and a resistive band having a number of strands such as twenty or more 36 may have a higher resistance and more desirable for a different consumer. The resistive band 13 in one configuration may comprise of fifteen strands of elastic at a specified outside diameter of 3/16" enabling approximately sixteen pounds of resistive angular displacement over a span of two to three inches and in another configuration of eighteen strands of elastic at a similar specified outside diameter of 3/16" resulting in approximately twenty one pounds of resistive angular displacement over a span of two to three inches and twenty strands of elastic at a similar specified outside diameter increasing the resistive force to about twenty four pounds displacement over a span of two to three inches. It may be desired to increase or reduce the number of strands, or increase or reduce the diameter of the resilient material to offer various levels of tension on the apparatus. The size of the elastic strand, and the number or strands may be designated for a variety of applications for example a desirable resistive band of 3/16" (5 mm) diameter sleeve with fifteen strands of elastic material at approximately 0.035" diameter strand provides a resistive load of less than that of a 20 strand material of 0.035" single strand of elastic material. The sleeve 32, made of a plastic or fabric like material to provide a sliding component onto the surface area of the base wherein the elastic internal to the cover is slip resistant, but the cover material or the sleeve 32 is required to move or slide on the base 11 surface area allowing the apparatus to function with tension on the elastic material, but also stretch in the elastic covered by the sleeve 32. The sleeve 32 material can be nylon, polypropylene or like plastic and or fabric material. It is desired to have a sleeve 32, made of a material that slides easily such as nylon, polypropylene or other like materials for uniform movement about the outer surface of the base 11. The force and displacement can be configured in one optional design with a lower number of elastic strands such as a fifteen strand with a resistive force of about one and half pounds over one inch displacement, and two and half pounds over three inches and three and half pounds over six inches. A higher number of strands such as a twenty strand elastic cord may result in a resistive force of three pounds over one inch and four pounds over three inches and six pounds over six inch displacement. If the sleeve 32 did not move, the tension from the elastic material alone would not provide sufficient movement or extension of the resistive band 13 for dorsiflexion movement of the lower leg extremity.

A combination of the physical properties of the material, number of strands within the resistive band 13 and the ability for movement between the resistive band 13 and the base 11 is desired for optimum performance of the apparatus. An alternative design, a spring made of metal configured with a sleeve 32 can be provide another resistive embodiment for the proposed invention. The combination of elastic material extending in combination with the sleeve 32 movement enables the apparatus to extend in synchronous cycles or movement with minimum wear on the device.

Figure 6:
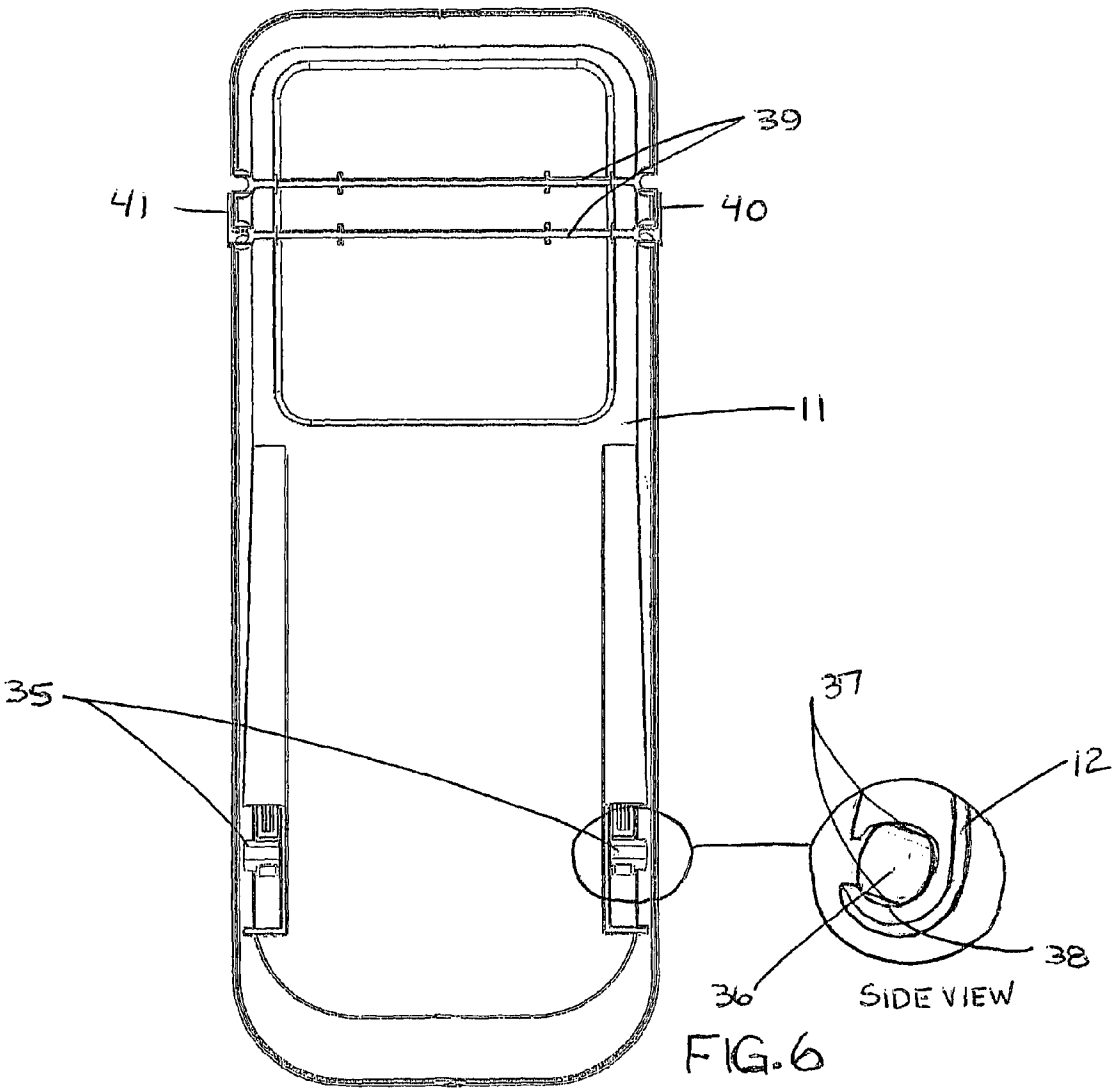
FIG. 6 is a bottom view of the base.

In referring to FIG. 6, a base 11, comprising a pin like features 35 configured to a circular pin with two flat parallel surfaces 37 a double "D" configuration 36. The pair of circular cross section pin like features 35 with two flats 37 extending from within the base 11 configured to receive the support arm 12. The pin like feature 35, is coupled to a "C" hook like feature 38 extending from an end of the support arm 12, wherein the hook like feature 38 can be rotated to engage the pin like feature 35 onto a shape 36 with two flats 37 between the "C" hook 38. The hook like feature 38 is then rotated to lock onto the pin like feature 35 within the base 11. The two design features enable the parts to be manufactured with minimum number of components and easy to assemble without tools. A resistive band guide 39 is configured to the base 11 bottom, comprising of a detail to guide the resistive band from one edge 40 to the opposite edge 41 of the base. The guide enables the resistive band 13 (as shown in one previous embodiment FIG. 1) to follow a path with no resistance to movement and allows the resistive band to move as desired when the apparatus is in use. An optional feature, a resistive band storage feature 42, is configured to the base 11, having a protrusion from the base wherein a resistive band can be wrapped or stored. The apparatus may also be optionally configured with a handle, markings, and or engravings for instructions or use.

It should be understood that the proceeding is a detailed description of one embodiment of the invention described within this specification and numerous changes to the disclosed embodiment can be made in accordance with the disclosures herein without departing from the spirit and scope of the invention.

The invention claimed is:

1. An exercise apparatus configured for resistive exercise of a user's lower leg comprising:

a base sized to accommodate a human foot and comprising:
- a rigid material;
- a bottom surface;
- a top surface; and
- a slip-resistant material;

a support arm comprising a pair of parallel extensions, each having two ends, and a cross support having two ends and configured to span the width of the user's foot, wherein one end of each parallel extension is attached to opposing end of the cross support and the opposite end of each parallel extension is pivotally attached to the base aft of the cross support;

a slot formed in a lateral surface at a forward area of the base; and a recess positioned at the forward area of the base on the top surface, wherein the top surface slopes toward the bottom surface at a front-most end of the base to form the recess, and wherein the recess is configured to receive the front end of the user's foot such that the user can rest the foot on the top surface and the toe area of the foot will be lower than the heel area; and a resistive band comprising resilient material and formed in a single closed loop, wherein the resistance band is attached to the base and passes through the slot and further the resistive band is attached to one end of the cross support;

wherein the support arms are configured to pivot relative to the base allowing the cross support to be raised by the user's forefoot against the resistance provided by the resistive band.

2. The apparatus of claim 1 wherein the resistive band comprises a single loop of material made of multiple strands of elastic and a cover.

3. The apparatus of claim 1 wherein the support arm is configured with a pad of soft material in the proximity of the foot engagement area.

4. The apparatus of claim 1 wherein the resistive band comprises multiple strands of elastic material, an outer sleeve of material and a fastener.

5. The apparatus of claim 1 wherein the resistive band provides one or more of the following features: visual indicator, color coded or a selectable tension.

6. The apparatus of claim 1 wherein the base is configured with a recessed area to provide an area for the frontal end of a foot to be placed into the apparatus without pre-loading the resistive band.

7. The apparatus of claim 1 wherein the resistive band comprises fifteen strands of elastic material assembled to a desired length to form a loop covered with an outer sleeve.

8. The apparatus of claim 1 wherein the resistive band comprises 20 strands of elastic material assembled to a desired length to form a loop covered with an outer sleeve.

9. The apparatus of claim 1 wherein the resistive band is made of one of the following materials: spring metal, latex, rubber, thermoplastic rubber, thermoplastic elastomer.

10. The apparatus of claim 1 wherein the base is configured with a trough and or an angled ramp to allow a foot to be inserted into the apparatus without pre-loading the resistive band.

* * * * *